US009267238B2

(12) United States Patent
Grove, III et al.

(10) Patent No.: US 9,267,238 B2
(45) Date of Patent: Feb. 23, 2016

(54) GLASS FIBER REINFORCED FACER MAT

(75) Inventors: Dale Addison Grove, III, Fort Wayne, IN (US); Alan Michael Jaffee, Bowling Green, OH (US); David Earl Weller, Jr., Greencastle, PA (US); Richard Thomas Giovannoni, Toledo, OH (US)

(73) Assignee: Johns Manville, Denver, CO (US)

( * ) Notice: Subject to any disclaimer, the term of this patent is extended or adjusted under 35 U.S.C. 154(b) by 107 days.

(21) Appl. No.: 13/557,274

(22) Filed: Jul. 25, 2012

(65) Prior Publication Data

US 2014/0030946 A1 Jan. 30, 2014

(51) Int. Cl.

| | |
|---|---|
| ***D21H 13/40*** | (2006.01) |
| ***E04C 2/04*** | (2006.01) |
| ***E04C 2/16*** | (2006.01) |

(52) U.S. Cl.

CPC ..... *D21H 13/40* (2013.01); *E04C 2/043* (2013.01); *E04C 2/16* (2013.01); *Y10T 442/2008* (2015.04); *Y10T 442/609* (2015.04)

(58) Field of Classification Search

USPC ..... 442/60, 335, 314

See application file for complete search history.

(56) References Cited

U.S. PATENT DOCUMENTS

| | | | | |
|---|---|---|---|---|
| 3,438,924 | A * | 4/1969 | Chalmers et al. | 524/160 |
| 3,583,522 | A * | 6/1971 | Rohweder | E04B 1/8409 181/290 |
| 7,700,505 | B2 * | 4/2010 | Leclercq | B32B 5/022 428/294.7 |
| 7,842,629 | B2 | 11/2010 | Jaffee | |
| 2004/0192148 | A1 * | 9/2004 | Kajander | 442/417 |
| 2005/0087901 | A1 * | 4/2005 | Yang et al. | 264/109 |
| 2006/0021148 | A1 * | 2/2006 | Weller, Jr. | 5/698 |
| 2008/0003903 | A1 * | 1/2008 | Nandi | 442/71 |
| 2013/0178126 | A1 * | 7/2013 | Bennett | 442/327 |

FOREIGN PATENT DOCUMENTS

| | | |
|---|---|---|
| EP | 2 083 129 A2 | 7/2009 |
| EP | 2 612 969 A2 | 7/2013 |

* cited by examiner

*Primary Examiner* — Lynda Salvatore
(74) *Attorney, Agent, or Firm* — Robert D. Touslee

(57) ABSTRACT

Embodiments of the invention provide fiber mat facers, ceiling panels, and method of manufacturing the same. A fiber mat facer may include a non-woven web of fibers having a first group of fibers with an average fiber diameter from about 6 μm to about 20 μm and a second group of fibers with an average fiber diameter from about 0.5 μm to about 5 μm. The fiber mat facer may also include a binder to bond together the non-woven web of fibers into the fiber mat. The binder may include a water repellant additive. The binder and/or fiber mat facer may further include an additive that enhances the opacity of the fiber mat facer. The fiber mat facer may also include a paint applied to an outer surface of the facer. The paint may include an additive that enhances the visual appeal of the facer and/or ceiling panel.

8 Claims, 3 Drawing Sheets

GLASS FIBER REINFORCED FACER MAT

BACKGROUND OF THE INVENTION

The present invention generally provides fiber mat facers that may be coupled with a ceiling panel to enhance the visual appeal of the ceiling panel, and more specifically provides fiber mat facers of various compositions described herein that enhance the visual appeal of the facers and, thus, the ceiling panels.

Facer products made of mats of bonded fibers are often attached to ceiling panels to enhance the aesthetic appeal, strength, sag resistance, and/or flame resistance of the ceiling panels. The ceiling panels are then often installed in suspended ceilings by inserting the ceiling panels into frames of the suspended ceiling. The facer products are attached to the side of the ceiling panel facing the room's interior so as to enhance the aesthetic appearance of the room. Since the ceiling panels will be used for perhaps many years and continually viewed during that period of time, it is important that the facer products attached to the ceiling panels be durable and provide long lasting visual appeal. Accordingly, there is a constant need for improved facer products that may be attached to ceiling panels that provide long lasting visual appeal.

BRIEF SUMMARY OF THE INVENTION

Embodiments of the invention generally provide fiber mat facers, ceiling panels, and methods of making the same that enhance the visual appeal of rooms in which the ceiling panels and facers are installed. According to one embodiment, a fiber mat facer is provided. The fiber mat facer may include a non-woven web of fibers that includes a first group of fibers having an average fiber diameter from about 6 μm to about 20 μm and a second group of fibers having an average fiber diameter from about 0.5 μm to about 5 μm. The fiber mat facer may also include a binder to bond together the non-woven web of fibers into the fiber mat. The binder may include a water repellant additive. The fiber mat facer and/or binder may further include an additive that enhances the opacity of the mat. In one embodiment, the additive that enhances opacity may include white pigment added to the binder and/or fiber mat facer.

The binder may also include a water repellant additive, which in one embodiment includes a stearylated melamine water repellant. In another embodiment, the binder includes a hexamethoxymethylolmelamine crosslinking agent. Paint may be applied to or atop an outer surface of the fiber mat. The paint may include a weak acid, which in one embodiment includes: sodium tetrafluoroborate, boric acid, and/or sodium hypochlorite. The binder may further include an amount of an anti-oxidant, such as sodium tetrafluoroborate.

In one embodiment, the first group of fibers have an average fiber diameter of about 11 μm and the second group of fibers may have an average fiber diameter of about 3 μm. The large diameter fibers and/or microfibers may include glass fibers such as E glass, C glass, T glass, sodium borosilicate glass, and the like, and mixtures thereof.

Exemplary compositions of the fiber mat facer may include white pigment between about 0.5 wt. % and 2.0 wt. % of the total weight of the fiber mat, the first group of fibers between about 60 wt. % and 71 wt. % of the total weight of the fiber mat, the second group of fibers between about 5 wt. % and 20 wt. % of the total weight of the fiber mat, the binder between about 15 wt. % and 25 wt. % of the total weight of the fiber mat, and/or the stearylated melamine water repellant between about 0.4 wt. % and 1.5 wt. % of the total weight of the fiber mat. It should be realized that the fiber mat facer need not necessarily include each of the above components or include the components within the above-defined ranges. For example, some facers may include one or more of the above described components and/or one or more of the components within the above described ranges, while not including one or more of the other components, or while including one or more of the other components in a range other than that described.

According to another embodiment, a faced ceiling panel is provided. The faced ceiling panel may include a fiber mat facer affixed to at least one surface of the ceiling panel. The fiber mat facer may be any of those described herein, such as including a non-woven web of fibers including: a first group of fibers having an average fiber diameter from about 6 μm to about 20 μm, a second group of fibers having an average fiber diameter from about 0.5 μm to about 5 μm, an acrylic binder to bond together the non-woven web of fibers, the acrylic binder including a water repellant additive, and an additive that enhances the opacity of the fiber mat facer. The ceiling panel may be a panel made of glass wool, mineral wool, fiberboard, wet felt, wood fibers, gypsum, and the like. In one embodiment, the fiberboard ceiling panel may have a composition of mineral wool, perlite, and newsprint fibers coated with a styrene-acrylate copolymer binder and may also include silica alumina extender particles.

According to another embodiment, a method for manufacturing a fiber mat facer is provided. The method may include blending a first group of fibers having an average fiber diameter from about 6 μm to about 20 μm with a second group of fibers having an average fiber diameter from about 0.5 μm to about 5 μm to form a non-woven web of fibers. The method may also include contacting the non-woven web of fibers with a binder solution to form a wet mat. The binder solution may include a water repellant additive and an additive that enhances the opacity of the fiber mat facer. The method may further include curing the wet mat to form a fiber mat. The method may additionally include applying paint to an outer surface of the fiber mat and, optionally, mixing a weak acid with the paint prior to applying the paint to the outer surface of the fiber mat.

The weak acid that is mixed with the paint may include sodium tetrafluoroborate, boric acid, sodium hypochlorite, and the like. The binder may include a stearylated melamine water repellant additive. The binder may also include sodium tetrafluoroborate that reduces yellowness of the fiber mat facer and/or applied paint. In one embodiment, the first group of fibers may have an average fiber diameter of about 11 μm and/or the second group of fibers may have an average fiber diameter of about 3 μm. In one embodiment, the additive that enhances the opacity of the fiber mat facer may include a white pigment.

BRIEF DESCRIPTION OF THE DRAWINGS

The present invention is described in conjunction with the appended figures.

Figure 1:
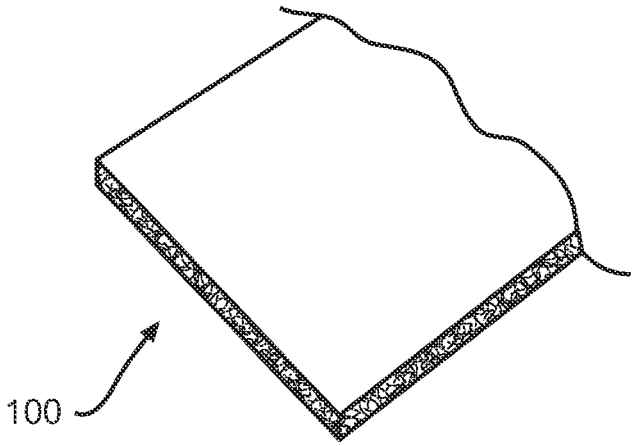
FIG. 1 illustrates a perspective view of a fiber mat facer according to an embodiment of the invention.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Embodiments of the invention provide fiber mat facers that may be coupled with boards, such as ceiling panels to provide an aesthetic appealing look and/or for other reasons. The fiber mat facers are generally used in ceiling applications due to the visually appealing appearance that they provide. The fiber mat facers have a flat, gloss-free surface and may be attached to ceiling panels to provide a corresponding appearance. The fiber mat facers also have a non-directional visual appearance, meaning that the appearance of the fiber mat facers is the same when viewed from any angle, or put another way, the appearance does not depend on the angle in which the fiber mat facer is viewed. In addition to enhanced visual appeal, the described fiber mat facers and ceiling panels provide smooth, clean, durable finishes that are washable, impact-resistant, scratch-resistant, soil resistant, water repellant, and scrubbable. They also provide sound absorption for sound blocking.

The fiber mat facers may include a blend of different sized fibers, which may be made of glass. The blend of fibers may include large diameter fibers that range in size between about 6 and about 25 μm, and small diameter fibers or microfibers that range in size between about 0.5 and 5 μm. In a specific embodiment, the larger diameter fibers may be about 11 μm diameter fibers and the microfibers may be about 3 μm in diameter. The fiber mat facers may also include a binder that bonds the large diameter fibers and microfibers together to form the fiber mat. The binder may be water repellant and/or include a water repellant additive such as a stearylated melamine water repellant.

An additive, such as white pigment, may be added to the fiber mat to increase the opacity of the mat. In some embodiments, the additive (e.g., the white pigment) is blended with, or otherwise added, to the binder and subsequently applied to the fiber mat, such as by applying the binder via a curtain coater to non-woven or wet-laid web of fibers. The additive (e.g., the white pigment) may enhance the light reflectance of the fiber mat when compared to similar fiber mats that do not have the additive.

Paint may be applied to an outer surface of the fiber mat facer to provide a ceiling panel having a desired color and/or finish. The water repellant binder and/or the microfibers may control or limit the absorption of the paint into the fiber mat facer. This may allow a controlled amount of paint to remain on the surface of the mat to provide the flat, gloss-free appearance. The paint may also include an amount of a weak acid that enhances the light reflectance and/or reduces the yellowness of the mat and/or paint in order to provide the desired appearance. These and other features of the invention will be more evident with reference to the figures.

Exemplary Fiber Mat Facers

Referring now to FIG. 1, illustrated is a fiber mat facer 100 that may be coupled with ceiling panels to enhance the visual appeal of the boards, such as by providing a flat, gloss-free surface. Fiber mat facer 100 includes a non-woven web of fibers that are bonded together to form the fiber mat. The non-woven web of fibers includes chopped continuous glass fibers, that may be a blend of larger diameter fibers (e.g., chopped strand fibers, staple fibers) and smaller diameter fibers (e.g., microfibers). In one embodiment, the large diameter fibers may have fiber diameters in the range between about 6 μm and about 20 μm. In other embodiments, the fiber diameters may range between about 8 μm and about 15 μm and/or between about 10 μm and about 13 μm. In a specific embodiment, the average fiber diameter of the plurality of large diameter fibers may be about 11 μm. The large diameter fibers may comprise glass or other fibers, such as E glass, C glass, T glass, sodium borosilicate glass, A & S glasses, Basalt, mineral wool, slag fiber, and the like, and mixtures thereof. The large diameter fibers may strengthen or reinforce the fiber mat.

As mentioned above, the non-woven web of fibers also includes a plurality of microfibers, which in one embodiment, includes fiber having diameters in the range between about 0.5 μm and about 5 μm. In other embodiments, the fiber diameters may range between about 1 μm and about 4 μm and/or between about 2 μm and about 3 μm. In a specific embodiment, the average fiber diameter of the plurality of large diameter fibers may be about 3 μm. In a specific embodiment, the microfibers are biosoluble, such as type 481 glass manufactured and/or sold by Johns Manville. The microfibers may include any of the fibers listed above, such as glass fibers. The microfibers may provide fiber mat facer 100 with a smooth appearance and/or provide a non-directional visual appearance so that facer 100 has essentially the same appearance when viewed from different angles. Mats without such microfibers may have a visual appearance when viewed in the machine direction (i.e., a direction aligned with the large diameter fibers) that is different from a visual appearance in the cross-machine direction. The microfibers may function as fillers between the large diameter fibers to provide the non-directional appearance. The microfibers may also decrease the air permeability of fiber mat facer 100, and allow for paint to remain on the surface of facer 100 to improve or enhance the light reflectance of facer 100. Air permeability is usually measured in cubic feet per minute per square foot of material at a fixed pressure of 0.5 inch $H_20$ (i.e., cfm @ ½" W.G.). The fiber mat facers 100 described herein may have air permeability values ranging between about 300 and 500, and more commonly between about 375 and 425. In some embodiments, the microfibers may be biosoluble fibers, such as those described in U.S. Pat. No. 5,945,360, titled "Biosoluble Pot and Marble-Derived Fiberglass" and U.S. Pat. No. 5,981,414, titled "Glass Fiber Composition with Improved Biosolubility", the entire disclosures of which are incorporated herein by reference for all purposes. These fibers may provide various health advantages over other conventional fibers.

The fiber length of the larger diameter fibers and the smaller diameter fibers used in the blend may be the same or different. Exemplary fiber lengths of the coarse fibers may include length between about 6 mm to about 18 mm while the smaller diameter fibers include lengths between about 1 mm to 6 mm. The web of fibers may also include fibers that are broken into two or more pieces and small glass fibers (e.g., less than 1 mm), chips, and flakes. Exemplary large diameter fibers include H117, a wet chopped fiber product available commercially from Johns Manville Corp under the trade name Chop-Pak®. The H117 fibers may have a fiber length of approximately 12 mm. Exemplary small diameter fibers include 110X-481, a micro-strand fiber product available commercially from Johns Manville Corp under the trade name Micro-Strand®. The larger diameter fibers may make up more than half the total weight of the fiber blend in the web. Exemplary quantities of the larger diameter fibers may include about 60 wt. % to about 75 wt. % of the total dry weight of fiber mat facer 100. In a specific embodiment, fiber mat facer 100 includes about 67 wt. %±2 wt. % of larger fibers. Exemplary quantities of the microfibers may include about 5 wt. % to about 20 wt. % of the total dry weight of fiber mat facer 100. In a specific embodiment, fiber mat facer 100 includes about 12 wt. %±2 wt. % of microfibers.

An organic or inorganic binder is usually added to the non-woven web of fibers to bond the non-woven web of fibers together into fiber mat facer 100. The binder may be formaldehyde free and may include epoxies, polyvinyl acetate, Ethylene vinyl chloride, PVC, Polyesters, and the like. In one embodiment, an acrylic thermoset is used due to its low flammability, low cost, thermal stability, color fastness, and the like. The binder may be an acrylic binder and may include a water repellant additive that limits the absorption of water based materials into the non-woven web of fibers, such as various paints. As with the microfibers or as an alternative to the microfibers, the water repellant binder may allow paint to remain on the surface of facer 100 to improve or enhance the light reflectance of facer 100. In some embodiments, the amount of absorption of paint within the non-woven web of fibers may be controlled and/or varied by varying the amount of water repellant additive used in the binder and/or by varying the amount of microfibers added to the non-woven web of fibers. Exemplary amounts of binder in fiber mat facer 100, based on its dry weight, may range from about 15 wt. % to 30 wt. %. In a specific embodiment, the amount of binder is about 20 wt. %±2.5 wt. %.

In some embodiments, the binder includes a hexamethoxymethylolmelamine crosslinking agent, such as, for example, those commercially available from Emerald Performance Materials under the trade name Aerotex® 3030. In other embodiments, the melamine-formaldehyde crosslinking agent is removed so that facer 100 is essentially formaldehyde free and may be used in applications requiring no formaldehyde added facers. In a specific embodiment, the binder includes a stearylated melamine water repellant. In another embodiment, paraffin and/or blends of stearylated melamine and paraffin may be used. Other water repellants may be used such as micronized waxes, oleyl, tallow, cetyl alcohol, and the like. Exemplary concentrations of the stearylated melamine in fiber mat facer 100, based on its dry weight, may range from about 0.4 wt. % to 1.5 wt. %, with a specific embodiment including about 0.6 wt. %±0.1 wt. %. In some embodiments, the binder may also or alternatively include an amount of an anti-oxidant, such as sodium tetrafluoroborate, BHT, EDTA, and the like. The sodium tetrafluoroborate may reduce the yellowness of the non-woven web of fibers in both a painted and unpainted state. Exemplary concentrations of the sodium tetrafluoroborate in fiber mat facer 100, based on its dry weight, may range from about 0.1 wt. % to 1.0 wt. %, with a specific embodiment including about 0.4 wt. %±0.1 wt. %. Exemplary sodium tetrafluoroborate products are available commercially from Shorechem, LLC.

In some embodiments, the binder may include other additives, such as flame resistant resinous binders such as urea formaldehyde, modified urea formaldehyde, acrylic resins, melamine resins, homopolymers or copolymers of polyacrylic acid; crosslinking acrylic copolymers (e.g., acrylic copolymers having a glass transition temperature (GTT) of at least about 25° C.); crosslinked vinyl chloride acrylate copolymers (e.g., copolymers having a GTT of about 113° C. or less), among other types of binders. Flame retardants may also be included in the binder, such as Alumina trihydrate, organic phosphonates, Antimony oxide, and the like.

An additive, such as in the form of a dispersion or pigment, may also be added to the non-woven web of fibers and/or the binder to enhance the opacity of fiber mat facer 100. The enhanced opacity of facer 100 due to the addition of the additive to the non-woven web of fibers and/or the binder may improve the overall flat, gloss-free surface and/or appearance of facer 100 compared to similar mats without the additive. In one embodiment, the additive comprises white pigment that is added to the binder and subsequently applied via a curtain coater to the non-woven web of fibers. The non-woven web of fibers may be cured to form fiber mat facer 100. Exemplary concentrations of the pigment or dispersion additive in fiber mat facer 100, based on its dry weight, may range from about 0.5 wt. % to 2.0 wt. %, with a specific embodiment including about 1.0 wt. %±0.1 wt. %. In a specific embodiment, a white pigment additive is used, such as those available commercially from BASF SE, under the tradename PureOptions KX White.

An outer surface of fiber mat facer 100 may include a paint or paint coating having a defined color and/or finish, such as a flat, gloss-free white color and finish. The paint may be applied to fiber mat facer 100 either before or after facer 100 is coupled with a board, such as on-site subsequent to installing the board in a structure. The paint or paint coating may include a weak acid, such as sodium tetrafluoroborate, boric acid, sodium hypochlorite, and the like. In one embodiment, the paint includes a binder that is reactive with the weak acid such that viscosity is increased by the weak acid addition. For example, the viscosity at high shear, such as in a spray nozzle, may be reduced to near that of the unmodified paint while at low shear the viscosity is increased. The binder may be polyvinyl acetate or a similar compound that provides the reaction with the weak acids. In one embodiment, the weak acids may have a pKa between about −2 and 14, and more commonly between about 4 and 12 or 9 and 12. The weak acid additive in the paint or paint coating may increase the light reflectance of facer 100 and/or reduce a yellowness of facer 100 and/or the paint while maintaining the flat, gloss-free surface and appearance of the painted facer 100. Exemplary concentrations of weak acids that may be added to the paint, based on the dry weight of the paint, are shown in the table below.

TABLE 1

Exemplary Acid Additives

| Additive | Amount | Exemplary Amount |
|---|---|---|
| Sodium Tetrafluoroborate | 0.25 wt. %-1.0 wt. % | 0.5 wt % ± 0.1 wt. % |
| Boric Acid | 0.5 wt. %-1.5 wt. % | 1.0 wt % ± 0.1 wt. % |
| Sodium Hypochlorite | 0.06 wt. %-1.2 wt. % | 0.09 wt % ± 0.01 wt. % |

Several additional exemplary embodiments of fiber mat facer 100 are provided in the tables below. The exemplary fiber mat facers had a mat basis weight in grams per square meter of between about 60 and 75 with an average of about 68. Although several exemplary embodiments are provided, the facers are not limited to these embodiments.

TABLE 2

| 1st Exemplary Fiber Mat Facer | | |
|---|---|---|
| Composition | Range Amount (dry weight %) | Exemplary Amount |
| Large Glass Fibers | 63-71 | 67 ± 1 |
| Microfibers | 8-16 | 12 ± 1 |
| Acrylic Binder | 15-25 | 20 ± 1 |
| hexamethoxymethylolmelamine Crosslinking Agent | 0.4-0.6 | 0.5 |
| White Pigment Additive | 0.5-2.0 | 1.0 ± 0.1 |

TABLE 3

| 2nd Exemplary Fiber Mat Facer | | |
|---|---|---|
| Composition | Range Amount (dry weight %) | Exemplary Amount |
| Large Glass Fibers | 63-71 | 67 ± 1 |
| Microfibers | 8-16 | 12 ± 1 |
| Acrylic Binder | 15-25 | 20 ± 1 |
| Stearylated Melamine Water Repellant | 0.4-1.2 | 0.6 ± 0.1 |
| White Pigment Additive | 0.5-2.0 | 1.0 ± 0.1 |

TABLE 4

| 3rd Exemplary Fiber Mat Facer | | |
|---|---|---|
| Composition | Range Amount (dry weight %) | Exemplary Amount |
| Large Glass Fibers | 63-71 | 67 ± 1 |
| Microfibers | 8-16 | 12 ± 1 |
| Acrylic Binder | 15-25 | 20 ± 1 |
| Stearylated Melamine Water Repellant | 0.4-1.2 | 0.6 ± 0.1 |
| White Pigment Additive | 0.5-2.0 | 1.0 ± 0.1 |
| Sodium Tetrafluoroborate | 0.2-0.8 | 0.4 ± 0.1 |

A paint may be added to the surface of any of the fiber mat facers described above. For example, in an exemplary embodiment, paint is applied to an outer surface of the 2nd exemplary fiber mat facer. The paint may include an additive, such as the above identified weak acids, that enhances the visual appeal of the fiber mat facer. The amount of the weak acid added to the paint may be within the ranges specified previously.

Figure 2:
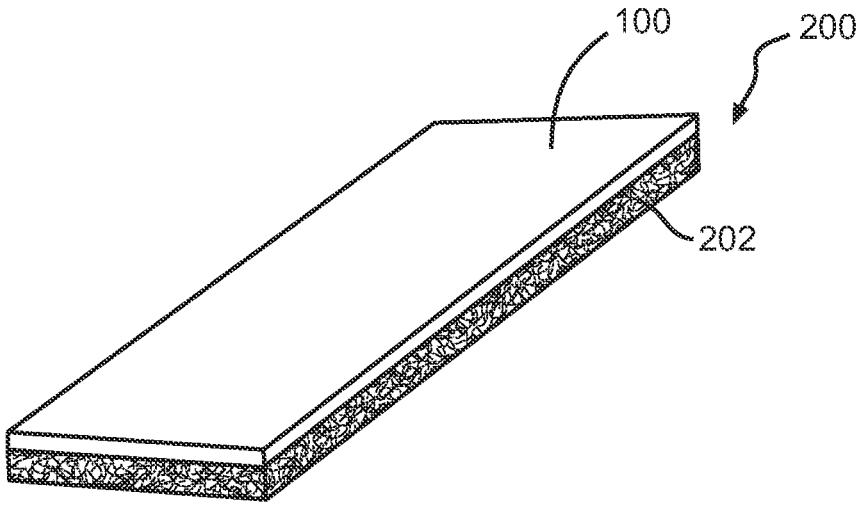
FIG. 2 illustrates a perspective view of the fiber mat facer of FIG. 1 coupled with a ceiling panel according to an embodiment of the invention.

Referring now to FIG. 2, illustrated is a perspective view of a faced ceiling panel 200 including a ceiling panel composite 202 and a fiber mat facer 100 overlaying and bonded to one surface of composite 202. Fiber mat facer 100 may be any of the facers described herein and may enhance the visual appeal of ceiling panel 200. Composite 202 may be a high-density polymer or predominantly polymer material or foam material core layer. Facer 100 may be substantially coextensive with, coextensive with, or extend beyond the major surface of composite 202. In one embodiment, composite 202 is made of glass wool, mineral wool, fiberboard, wood fibers, gypsum, and the like.

Exemplary Methods

Figure 3:
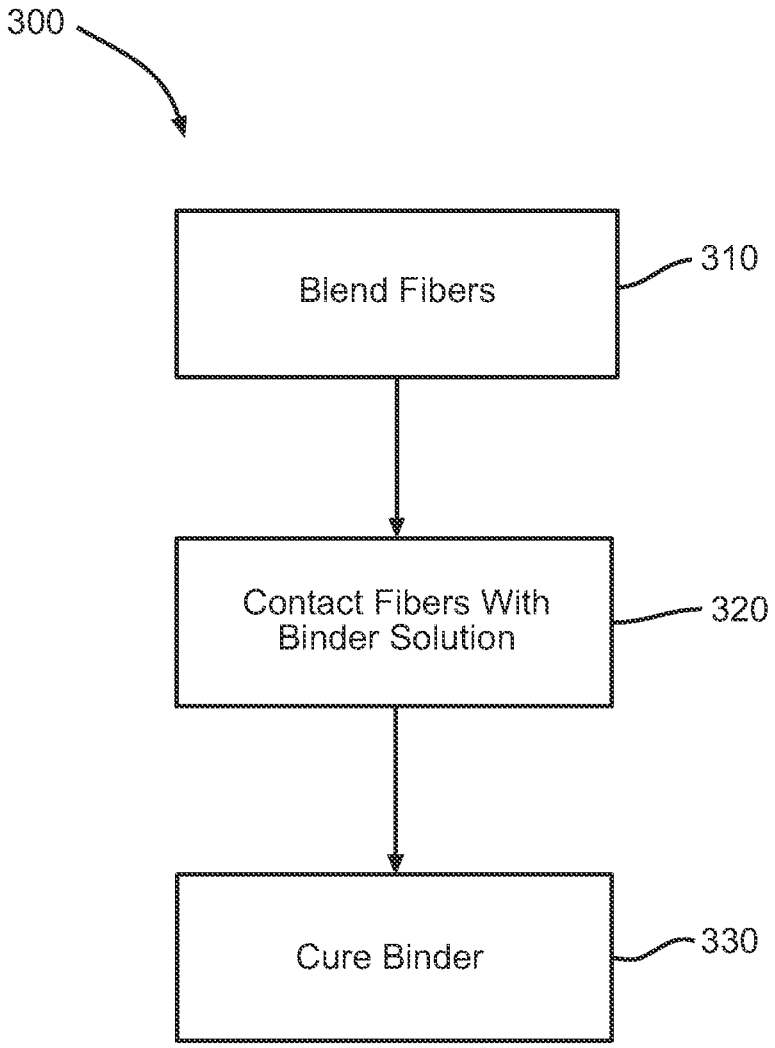
FIG. 3 illustrates a method for manufacturing a fiber mat facer according to an embodiment of the invention.

Referring now to FIG. 3, illustrated is a method 300 for manufacturing a fiber mat facer. At block 310, a first and second group of fibers may be blended to form a non-woven web of fibers. The first group of fibers may have an average fiber diameter of about 6 μm to about 20 μm, while the second group of fibers may have an average fiber diameter of about 0.5 μm to about 5 μm. In a specific embodiment, the first group of fibers have an average fiber diameter of about 11 μm while the second group of fibers have an average fiber diameter of about 3 μm. An exemplary technique for the blending may include the forming of a slurry (e.g., an aqueous slurry) with the fibers. The fiber slurry may then be mechanically agitated to dispense the fibers more homogeneously through the slurry. Following the agitation, the slurry may be dispensed on a moving screen. A vacuum may be applied to remove a substantial part of the aqueous solution, which may be recycled into more solution for the slurry. With a substantial portion of the aqueous solution removed, the non-woven web of fibers is formed on the moving screen.

At block 320, the non-woven web of fibers may then be contacted with a binder solution 204 to form a wet mat. The binder solution may be an aqueous binder solution applied to the web using, for example, a curtain coater or a dip-and-squeeze applicator. Excess binder solution may pass through the screen supporting the binder-coated wet mat. The binder may be any of the binders and/or include any of the additives described herein. For example, the binder may include a water repellant additive (e.g., stearylated melamine), a pigment or dispersion additive (e.g., white pigment), sodium tetrafluoroborate, or other antioxidants, and the like.

At block 330, the wet mat may then be cured to form a fiber mat. Exemplary curing techniques may include heating using thru air dryers, flotation dryers, steam drums, oil heated drums, among other techniques. Continuing with the moving screen technique described above, heat may be applied following the removal of excess binder through the web of fibers to evaporate any remaining water and cure the polymer precursors in the binder solution into a polymerized binder that bonds together the fibers. The heat source may be an oven through which the wet mat is conveyed on the moving screen.

In some embodiments, the process of manufacturing the fiber-reinforced mat may be a continuous process, with the moving screen providing a continuous, conveyor-like loop that may be on a slight upward incline while the fiber slurry is deposited thereon. Subsequently, the excess slurry solution is removed and the non-woven web of fibers is conveyed to an area where binder solution is applied. Following the spraying, curtain coating, etc., of the binder solution, the wet mat is conveyed on the moving screen through an oven for the drying of the mat and polymerization of the binder. Exemplary heating conditions may include subjecting the wet mat to temperatures of about 120° C. to about 330° C. for periods of, for example, 1 to 2 minutes, less than 40 seconds, etc. The final mat may have a thickness of, for example, about 10 mils to about 30 mils.

Figure 4:
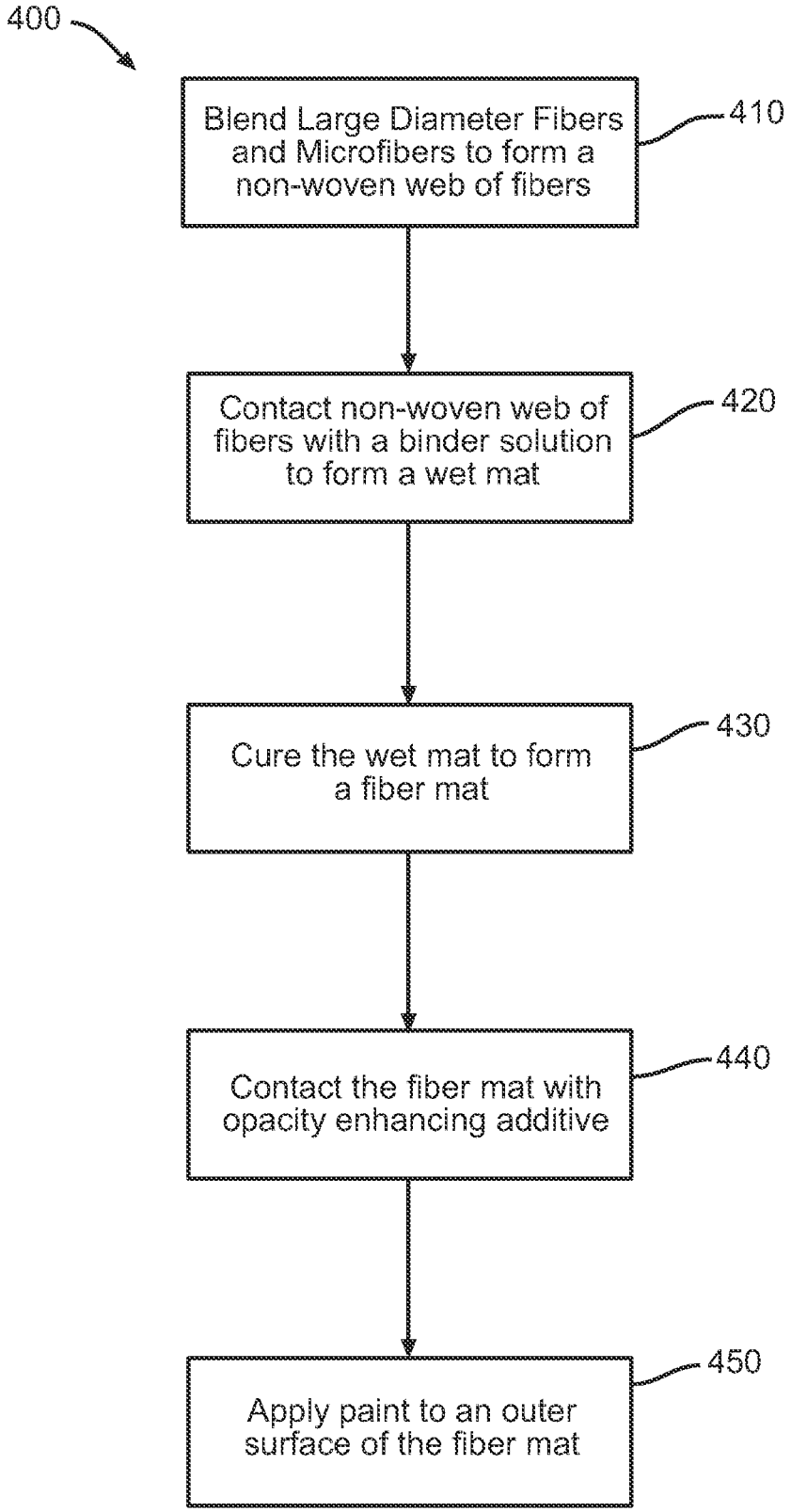
FIG. 4 illustrates another method for manufacturing a fiber mat facer according to an embodiment of the invention.

Referring now to FIG. 4, illustrated is another method 400 for manufacturing a fiber mat facer. Method 400 is similar to method 300 in that at block 410 large diameter fibers and microfibers are blended to form a non-woven web of fibers, which web of fibers is contacted at block 420 with a binder solution to form a wet mat. Similarly, at block 430, the wet mat is cured to form a fiber mat. Method 400 is different than method 300 in that it includes the additional steps of contacting the fiber mat with an opacity enhancing additive (block 440) and applying paint to an outer surface of the fiber mat (block 450). The step of contacting the fiber mat with an opacity enhancing additive (block 440) is an optional step that may be performed if the binder does not include an opacity enhancing additive, such as white pigment, or as an additional step even if the binder does include such additive. The step of contacting the fiber mat with an opacity enhancing additive may be performed by applying the additive via a curtain coater, dip process, and the like, or adding the additive to the slurry of blended large and small fibers. Typically, however, the opacity enhancing additive is included in the binder and step 440 is not performed.

The step of applying paint to an outer surface of the fiber mat (450) may be performed to provide a desired color and/or finish to the final fiber mat facer, such as to provide a flat, gloss-free finish. The paint may be applied via roll coating, knife coating, spraying, and the like. As described herein, the microfiber and/or water repellant binder composition of the fiber mat may limit the amount of absorption of the paint into the fiber mat so that a portion of the paint remains on or near the outer surface of the fiber mat to improve the brightness and/or light reflectance of the mat and provide the desired flat, gloss-free surface and appearance. The amount of paint that remains on the surface may be controlled or varied by varying the composition of the microfibers and/or water repellant binder. For example, control may be provided by selection of repellent chemistry and/or dispersant chemistry in the binder to achieve a surface energy of between about 40 dyne/cm and 50 dyne/cm, and more commonly about 45 dyne/cm. In one embodiment, the binder chemistry may be selected so that the dispersive and polar components of the surface energy may be balanced at an approximate ratio of 2:1 to provide one or more of the desired facer characteristics described herein. In a specific embodiment, the binder chemistry includes a dispersive component of about 30 d/cm and a polar component that ranges between about 10 and 20 d/cm so that the approximate ratio of 2:1 is provided. The exemplary compositions described herein, however, are sufficient to provide the desired flat, gloss-free surface and appearance.

Method 400 may further include the step (not numbered) of mixing an additive (e.g., the described weak acids) with the paint prior to applying the paint to the outer surface of the fiber mat. The weak acids mixed with the paint may include sodium tetrafluoroborate, boric acid, sodium hypochlorite, and the like. These additives may improve the light reflectance of the fiber mat facer and/or reduce yellowness of the fiber mat facer so as to enhance the visual appeal of the fiber mat facer. These additives may be added in the amounts described herein, which are sufficient to enhance the visual appeal of the resulting fiber mat facers. The fiber mat facers described in or produced by methods 300 and 400 may be coupled with a ceiling panel and subsequently installed in a building or structure to provide enhanced visual appeal to the building or structure.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A method for manufacturing a fiber mat facer comprising:

forming an aqueous slurry blend of a first group of fibers having an average fiber diameter from about 6 μm to about 20 μm and a second group of fibers having an average fiber diameter from about 0.5 μm to about 5 μm;

dispensing the aqueous slurry on a screen and removing a substantial portion of the aqueous solution to form a non-woven web of fibers;

applying an aqueous binder solution to the non-woven web of fibers to form a wet mat, the binder solution including between about 0.4 wt. % and 1.5 wt % of a water repellant additive and between about 0.5 wt. % and 2.0 wt % of a white pigment additive that enhances the opacity of the fiber mat facer;

curing the wet mat to form a fiber mat; and coupling the fiber mat with a ceiling panel, the ceiling panel being for subsequent installation in a ceiling of a structure;

wherein the fiber mat includes between about 63 and 71 dry weight percent of the first group of fibers having an average fiber diameter from about 6 μm to about 20 μm and between about 8 and 16 dry weight percent of the second group of fibers having an average fiber diameter from about 0.5 μm to about 5 μm, the fiber mat having an air permeability of between about 300 and 500 cfm/ft$^2$.

2. The method of claim 1, further comprising applying paint to an outer surface of the fiber mat, wherein the binder includes either or both a repellent chemistry or dispersant chemistry that provides a surface energy of between 40 dyne/cm and 50 dyne/cm so that absorption of the pain into the fiber mat is limited and a portion of the paint remains on or near the outer surface of the fiber mat.

3. The method of claim 2, further comprising mixing between 0.25 wt. % and 1.0 wt. % of a weak acid with the paint prior to applying the paint to the outer surface of the fiber mat.

4. The method of claim 3, wherein the paint further comprises a binder that is reactive with the weak acid to increase the viscosity of the paint at low shear.

5. The method of claim 1, wherein the water repellant additive comprises stearylated melamine water repellant.

6. The method of claim 1, wherein the binder comprises sodium tetrafluoroborate.

7. The method of claim 1, wherein the first group of fibers have an average fiber diameter of about 11 μm.

8. The method of claim 1, wherein the second group of fibers have an average fiber diameter of about 3 μm.

* * * * *